US006331084B1

(12) United States Patent
Ohba

(10) Patent No.: US 6,331,084 B1
(45) Date of Patent: Dec. 18, 2001

(54) CONTAINER FOR FEEDING STICK TYPE COSMETIC MATERIAL

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/529,670

(22) PCT Filed: Dec. 24, 1998

(86) PCT No.: PCT/JP98/05887

§ 371 Date: Jul. 14, 2000

§ 102(e) Date: Jul. 14, 2000

(87) PCT Pub. No.: WO99/33373

PCT Pub. Date: Jul. 8, 1999

(30) Foreign Application Priority Data

Dec. 25, 1997 (JP) ..... 9-366309

(51) Int. Cl.[7] ..... A45D 40/04
(52) U.S. Cl. ..... 401/68; 401/87
(58) Field of Search ..... 401/68, 75, 76, 401/86, 87, 88

(56) References Cited

U.S. PATENT DOCUMENTS 3,216,563 * 11/1965 Finkenzeller ..... 401/76
6,200,047 * 3/2001 Holloway ..... 401/75

FOREIGN PATENT DOCUMENTS 56-54881 12/1981 (JP) .
59-130612 9/1984 (JP) .
9-56465 3/1987 (JP) .
3-8186 2/1991 (JP) .
4-60118 5/1992 (JP) .
6-245814 9/1994 (JP) .

* cited by examiner

*Primary Examiner*—Gregory L. Huson
*Assistant Examiner*—Peter deVore
(74) *Attorney, Agent, or Firm*—Rabin & Berdo, P.C.

(57) ABSTRACT

A container for feeding a stick type cosmetic material which can reduce the number of parts employed therein and can easily be assembled is provided. The container for feeding a stick type cosmetic material 1 comprises a chuck 41 for retaining a stick type cosmetic material 3, a front cylinder 11, a push rod 47 having external-thread-shaped projections 49 on its outside surface, and a body cylinder 15 which has internal threads 63 to be spirally engaged with the external-thread-shaped projections 49. Unevennesses 49*a* having the same sections are formed on a peripheral surface of the external-thread-shaped projections 49 of the push rod 47 in an axial direction. On an inside surface of the front cylinder, synchronous engagement grooves 31 which are engaged with the unevennesses 49*a* and synchronously engage the push rod 47 and the front cylinder 11 are formed.

11 Claims, 12 Drawing Sheets

CONTAINER FOR FEEDING STICK TYPE COSMETIC MATERIAL

TECHNICAL FIELD

The present invention relates to a container for feeding a stick type cosmetic material, such as lipstick, eyeliner, or the like. Particularly, it relates to a container for feeding a stick type cosmetic material which can reduce the number of parts employed therein and can easily be assembled. Further, it relates to a container for feeding a stick type cosmetic material which is also suitable for direct filling of cosmetic materials.

BACKGROUND ART

One of the conventional containers for feeding a stick type cosmetic material is disclosed in Japanese Utility Model Laid-Open Publication No. Sho 59-130612. As shown in FIG. 13, a feeding mechanism of the container for feeding a stick type cosmetic material excluding a container body cylinder is composed of a push rod 943 with a cosmetic material supporting bowl 941, a front cylinder sleeve 949, and an internal thread cylinder 957. The push rod 943 is connected to a lower part of the cosmetic material supporting bowl 941 as one body, and a stopper 945 is projecting at a tail section of the push rod 943. The cosmetic material supporting bowl 941 slides on an inside surface of the front cylinder sleeve 949. An external thread installed on an outside surface of the push rod 943 is spirally engaged with an internal thread 955 installed on an inside surface of an upper part of the internal thread cylinder 957.

The stopper 945 installed at the push rod 943 of the container for feeding a stick type cosmetic material is shaped like a downward wedge. That is to say, a lower side surface of the stopper 945 is a taper 946, and an upper side surface is a contact surface 944 which extends sideward. A flange 951 which extends to an inside surface of the front cylinder sleeve 949 is engaged with the stopper 945.

More specifically, a flange hole 953 provided inside the flange 951 has a shape which definitely corresponds to a section of the stopper 945 installed at a tail end of the push rod 943. However, a distance of two parallel walls of the flange hole 953 which are provided in parallel with each other is slightly narrower than a width of the stopper 945 of the push rod 943. Incidentally, a similar stopper is also installed on a backside of the push rod 943.

Therefore, when the push rod 943 is built into the front cylinder sleeve 949 at the time of assembly, the supporting bowl 941 is pushed downward so that the stopper 945 of the push rod 943 passes through (press fit) the flange hole 953 of the front cylinder sleeve 949. The taper 946 provided under the stopper 945 is used for facilitating the press fit. After the stopper 945 passes through the flange hole 953, the contact surface 944 provided on an top surface of the stopper 945 comes into contact with an under surface of the flange 951, whereby the push rod 943 does not get out of the front cylinder sleeve 949. Thus, a feeding end of the push rod 943 is defined.

Such a conventional container for feeding a stick type cosmetic material is aimed for reduction of the parts to be employed therein and facilitation of assembly. However, it is necessary to align the push rod 943 and the front cylinder flange hole 953 at around the axial at the time of assembly, whereby it is not easy to assemble.

On the other hand, in the case of a container in which direct filling of a cosmetic material is carried out after assembly, in order to prevent damage, such as fracture of the cosmetic material, coming off a chuck (cosmetic material retaining section), or the like, it is important to reduce slide resistance of the cosmetic material and the front cylinder hole and to feed or retract the cosmetic material straight to the front cylinder without weaving of the chuck.

DISCLOSURE OF THE INVENTION

The present invention is made in order to cope with such problems. An object of the present invention is to provide a container for feeding a stick type cosmetic material which can reduce the number of parts employed therein and can easily be assembled.

Further, another object of the present invention is to provide a container for feeding a stick type cosmetic material which is also suitable for direct filling of the cosmetic material.

In order to achieve the objects described above, the container for feeding a stick type cosmetic material according to the present invention is characterized in that there are provided a chuck which retains a stick type cosmetic material, a front cylinder having an internal hole which guides the chuck to easily slide in an axial direction, a push rod which is connected with the chuck and has external-thread-shaped projections on its outside surface, and a body cylinder which is rotatably connected with the front cylinder and also has internal threads to be spirally engaged with the external-thread-shaped projections of the push rod, and unevennesses having an almost same section are formed on a periphery surface of the external-thread-shaped projections of the push rod in an axial direction and synchronous engagement unevennesses, which synchronously engage the push rod and the front cylinder by being engaged with the aforementioned unevennesses, are formed on an inside surface of the front cylinder.

In the container for feeding a stick type cosmetic material according to the present invention like conventional containers, when the front cylinder and the body cylinder are relatively rotated, the external-thread-shaped projections of the push rod which rotates synchronously with the front cylinder advance in the internal threads of the body cylinder and the push rod is fed or retracted. Here, since unevenness sections of the push rod and the front cylinder to synchronously engage the both are formed, the synchronous engagement sections are smoothly engaged, whereby the push rod and the chuck can smoothly be fed or retracted.

In the present invention, it is preferable that the synchronous engagement unevennesses are formed on an entire circumference of the inside surface of the front cylinder. Even if the push rod is built into the front cylinder at any rotating position, the unevennesses of the push rod and the synchronous engagement unevennesses of the front cylinder will be engaged. Thus, alignment is not required at the time of assembly of the push rod, thereby remarkably improving efficiency of the assembly work. Further, even though an unevenness of the push rod is provided at one place, similar effect can be achieved, but to provide a plurality of unevennesses surpasses in strength.

Further, it is preferable that the synchronous engagement unevennesses are formed on an inside surface of a flange provided at a lower part of the internal hole for sliding the chuck of the front cylinder. More specifically, by eliminating any synchronous engagement unevenness or rib from the internal hole in which a cosmetic material slides, a periphery of the cosmetic material is not uneven and friction is reduced when the cosmetic material which is fluid after the assembly is directly filled in the internal hole and solidificated, whereby the cosmetic material can smoothly be fed or retracted.

Further, it is preferable to have the following constitution: the push rod is formed in a manner that the push rod is one with the chuck; at a tail section of the push rod, there are provided bend stoppers which have outward projections projecting over a periphery surface of the push rod; a stopper contact section is provided at a lower part of each internal thread of the body cylinder; when the push rod is passed through the body cylinder at the time of assembly, the bend stoppers bend inward so that the bend stoppers can pass inside the internal threads; and after the assembly, the bend stoppers are restored to an original form; and at the feeding end of the push rod, the bend stoppers come into contact with the stopper contact sections, whereby the feeding limit of the push rod is defined.

In the case of the container for feeding a stick type cosmetic material which directly fills up a cosmetic material, the internal hole of the front cylinder in which the cosmetic material slides is straight, and therefore it is impossible to provide a step which a tip of the chuck comes into contact with so as to define a stroke end. If the feeding limit of the push rod is defined by forming the bend stoppers at the push rod as described above, it will be possible to define the stroke end without increase of the number of parts and the labor.

Further, it is preferable that the push rod with a chuck is molded out of plastic into the form of a half mold by injection and the aforementioned external-thread-shaped projections are plurally formed at a position apart from the molding parting line facing each other with a shaft center of the push rod between. The parting line does not touch the external-thread-shaped projections and therefore surfaces of the projections can be smooth. Thus, a clearance at the time of spiral engagement or slide can be reduced and also smooth feeding and retracting without hitching can be performed. Further, resistance is uniformly imposed on right and left of the push rod because the external-thread-shaped projections are arranged in such a manner that they face each other. Thus, the push rod and the chuck do not swing at the time of feeding and retracting, whereby the cosmetic material is prevented from being damaged or coming off.

Further, it is preferable that the external-thread-shaped projections of the push rod are formed extending over the length equivalent to or greater than a stroke of the container and the internal threads are installed on the tip side of the body cylinder extending over the length which is enough for the internal threads to be spirally engaged with several of the external-thread-shaped projections. A range of forming the internal threads can be shorten and a reduction of the size of the container and a decrease of costs can be realized.

Further, it is preferable that the body cylinder has internal and external double cylindrical structure in which two cylindrical bodies are connected with each other at their tail sections and a bottom section of the front cylinder is rotatably engaged between the both cylindrical bodies. Rotatable connection of the front cylinder and the body cylinder is firm and the both cylinders will not incline even though force is applied, and a container which has a high-grade atmosphere and is reliable can be realized.

BRIEF DESCRIPTION OF THE DRAWINGS

FIG. 6 shows the internal structure of a container for feeding a stick type cosmetic material according to yet another embodiment of the present invention.

FIG. 11 shows a front cylinder of the container shown in FIG. 10.

FIG. 12 shows a body cylinder of the container shown in FIG. 10.

BEST MODE FOR CARRYING OUT THE INVENTION

A preferred embodiment of the present invention will subsequently be described with reference to the accompanying drawings.

Figure 1:
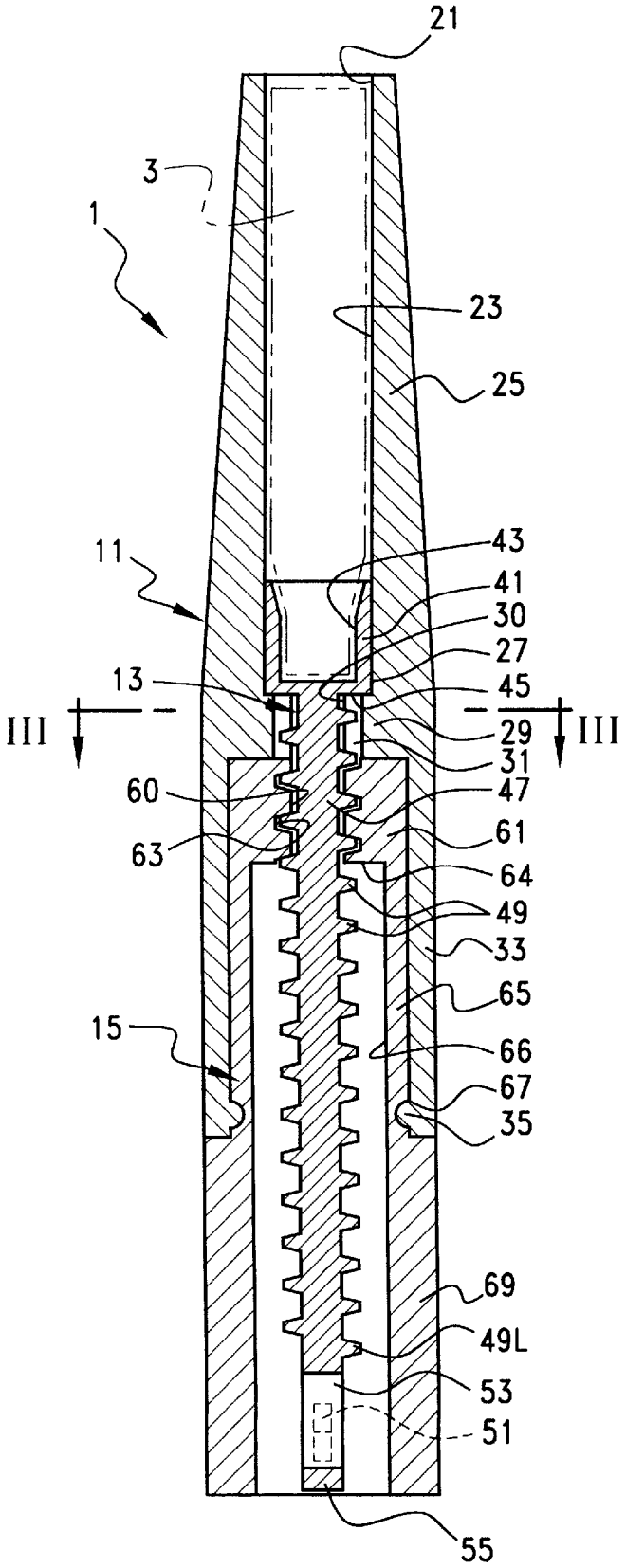
FIG. 1 is a sectional view showing the internal structure of a container for feeding a stick type cosmetic material according to an embodiment of the present invention.
Figure 2:
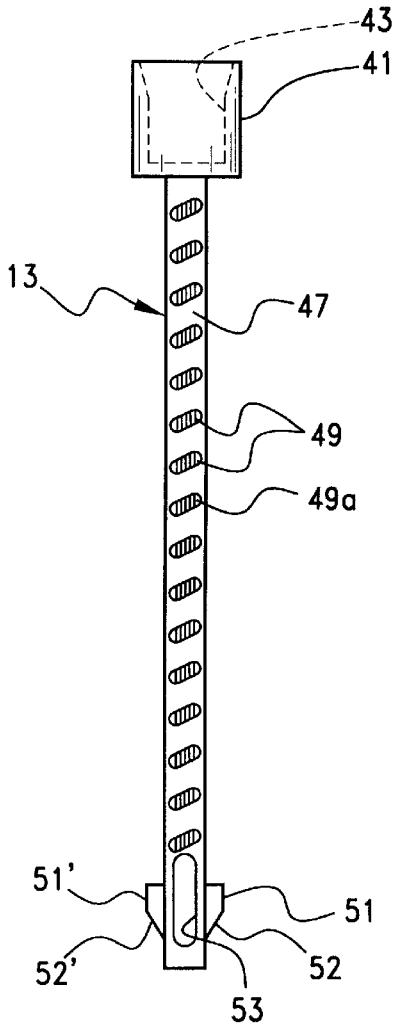
FIG. 2 is a side view showing a push rod with a chuck of the container for feeding a stick type cosmetic material shown in FIG. 1.
Figure 3:
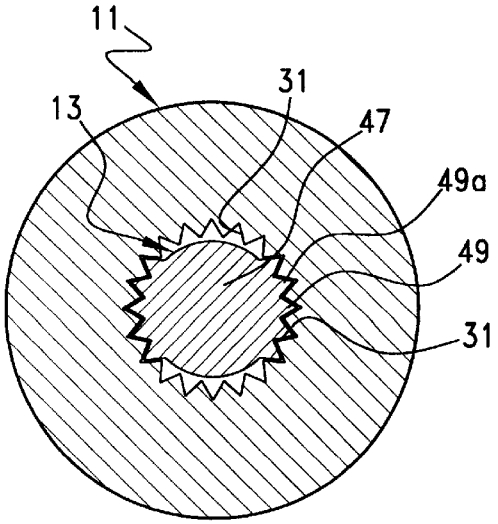
FIG. 3 is a sectional view taken along line III—III of the container for feeding a stick type cosmetic material shown in FIG. 1.

FIG. 1 is a sectional view showing the internal structure of a container for feeding a stick type cosmetic material according to an embodiment of the present invention. FIG. 2 is a side view of a push rod with a chuck of the same container for feeding a stick type cosmetic material. FIG. 3 is a sectional view of the container for feeding a stick type cosmetic material.

The container for feeding a stick type cosmetic material according to the embodiment is composed of three parts: a front cylinder 11, a push rod 13 with a chuck, and a body cylinder 15. The chuck 41 and the push rod 47 are united (the push rod 13 with a chuck). A cosmetic material 3 is filled in the front cylinder 11. A tail section of the cosmetic material 3 is inserted into the chuck 41 and supported. When the chuck 41 is moved by the push rod 47 and goes up and down in the front cylinder 11, accordingly the cosmetic material 3 is fed from or retracted to a tip opening 21 of the front cylinder 11.

The front cylinder 11 is hollow and cylindrical as a whole and is composed of a cosmetic material storage 25 provided at an upper part, a flange 29 provided at a center section, and a rotatable connection section 33 provided at a lower part. An inside surface of the cosmetic material storage 25 is a cylindrical internal hole 23 in which the cosmetic material 3 and the chuck 41 slide. An inside diameter of the flange 29 is small and vertical synchronous engagement grooves 31 are provided extending over the entire internal circumference of the inside surface in an axial direction.

Incidentally, the synchronous engagement grooves 31 correspond to synchronous engagement unevennesses of the present invention. The synchronous engagement grooves 31 are engaged with unevennesses 49*a* of external-thread-shaped projections 49 which are arranged in line on an outside surface of the push rod 47 and become a whirl-stop of the push rod 47 and the front cylinder 11. In other words, the front cylinder 11 and the push rod 47 are synchronously rotated.

A further lower part of the flange 29 of the front cylinder 11 is the rotatable connection section 33. The rotatable connection section 33 has a relatively large inside diameter, and an internal thread section 61 and a rotatable connection section 65 of the body cylinder 15 are stored in the inside diameter section.

An annular convex 35 is formed on an inside surface of the tail section of the rotatable connection section 33. The annular convex 35 is engaged with an annular concavity 67 provided on an outside surface of the body cylinder 15 and rotatably connects the front cylinder 11 and the body cylinder 15.

The chuck 41 has a cylindrical shape with a bottom and the tail section of the cosmetic material 3 is stored and retained in a cavity section 43 provided inside the chuck 41. The diameter of the chuck 41 is larger than the push rod 47, and at the retracting limit of the push rod 47, a bottom plate 45 of the chuck 41 comes into contact with an internal step 27 of the front cylinder 11 and the stroke end is defined.

The push rod 47 is formed on the tail end side of the chuck 41 as one body. On an outside surface of the push rod 47, almost elliptical external-thread-shaped projections 49 are put in two lines at each 180° degrees in a direction of the circumference of a circle. A distance between the projections 49 which adjoin each other at the upper and lower sides of each line is at a constant pitch. Lines of the projections 49 which adjoin each other in a direction of the circumference of a circle are arranged in such a manner that a step is provided at every half pitch. These projections 49 are arranged in straight line toward the axial direction and also in such a manner that a virtual spiral is drawn on an outside surface of the push rod 47 (the projections cover a part of the external thread).

As shown in FIG. 3, five unevennesses 49*a* are successively installed at a constant pitch on a periphery surface of the external-thread-shaped projections 49. These unevennesses 49*a* serve as ribs having the same section which extend straight toward the axial direction of the push rod 47. Here, the push rod 13 with a chuck is molded out of plastic into the form of a half mold by injection and the external-thread-shaped projections 49 are formed at a position apart from the molding parting line facing each other with a shaft center of the push rod between.

The unevennesses 49*a* provided on a periphery surface of the external-thread-shaped projections 49 form a straight line toward the axial direction and are engaged with the synchronous engagement grooves 31 of the front cylinder 11 so as to serve as a whirl-stop of the push rod 47 and the front cylinder 11. Further, the external-thread-shaped projections 49 are spirally engaged with internal threads 63 provided on an inside surface of the body cylinder 15. More specifically, the same spiral (having a clearance) as the virtual spiral formed by the external-thread-shaped projections 49 is formed as the internal threads 63.

At the tail end of the push rod 47, a bend stopper 51 projecting outward from a periphery surface of the tail section is provided. At the center of the bend stoppers 51 and 51' which are installed right and left, a slit 53 which passes through the push rod 47 is opened. Due to the presence of the slit 53, when force to tighten the bend stoppers 51 and 51' from their outside acts, an elastic deformation occurs to the bend stoppers 51 and 51'. Thus, the bend stoppers 51 and 51' makes an approach to the shaft center of the push rod 47, thereby narrowing a distance between the outside surfaces of the bend stoppers 51 and 51'. Further, lower sides of the bend stoppers 51 and 51' are surfaces 52 and 52' which are tapered downward.

Therefore, when the push rod 47 is built in the front cylinder 11 or the body cylinder 15, if the tail end of the push rod 47 is pushed from the topside into the synchronous engagement groove 31 of the front cylinder or the center hole of the internal thread 63, the tapered surfaces 52 and 52' will be pressed from the both outsides and the slit 53 becomes narrower. Thus, the bend stoppers 51 and 51' installed right and left approach to the respective inward sides and the distance between them becomes narrower, whereby the bend stoppers 51 and 51' can pass through the synchronous engagement grooves 31 and the internal thread sections 61.

However, after the bend stopper 51 passes through the internal thread section 61 or the like, spring back of the stopper 51 occurs and the stopper 51 widens toward right direction and left direction again. If the push rod 47 is fed upward in this state, an upper surface of the bend stopper 51 comes into contact with an inner step section 64 provided at a lower end of the internal thread section 61 of the body cylinder 15 which will be described later, whereby feeding of the push rod 47 is restricted.

The body cylinder 15 is hollow and cylindrical as a whole and comprises the internal threads 61 at the upper part, the rotatable connection sections 65 at the center, and bottom sections 69 at the lower part. The internal thread section 61 is thick, and the internal thread 63 is formed on an inside surface of the internal thread section 61. The internal thread 63 is spirally engaged with the external-thread-shaped projection 49 described above. The rotatable connection section 65 is fitted into an inside surface of the rotatable connection section 33 of the front cylinder 11 together with the internal thread section 61. The annular concavity 67 described above is formed on an outside surface of a tail end of the rotatable connection section 65. The bottom section 69 is a part of the body cylinder 15 which is projecting over an outside surface of the container. At the time of feeding the cosmetic material, the bottom section 69 is picked with fingers and rotated relatively to the front cylinder 11.

When the cosmetic material 3 is fed using the container for feeding a stick type cosmetic material shown in FIG. 1, the body cylinder 15 and the front cylinder 11 are relatively rotated (for example, the front cylinder 11 is fixed with fingers of a left hand and the bottom section 69 of the body cylinder 15 is rotated with fingers of a right hand). Then, the front cylinder 11, the chuck 41, and the push rod 47 are not rotated and the body cylinder 15 is rotated. Therefore, the external-thread-shaped projections 49 which also operate as the external threads on an outside surface of the push rod 47 are pushed by the internal threads 63, whereby the push rod 47 is fed in an axial direction (ascends).

When the push rod 47 ascends, the bend stopper 51 installed at a tail end of the push rod 47 ascends and finally comes into contact with the inner step section 64 which is a lower end surface of the internal thread section 61. Feeding of the push rod 47 becomes impossible at this point, and feeding of the push rod 47 will be restricted.

In order to retract the push rod 47, it will be sufficient if the front cylinder 11 and the body cylinder 15 are rotated in an opposite direction. Incidentally, the retracting end of the push rod 47 is defined by the contact of a bottom 45 of the chuck 41 with the upper step section 27 of the synchronous engagement groove 31 provided in the front cylinder 11.

At the time of assembling the container for feeding a stick type cosmetic material according to this embodiment, the front cylinder 11 and the body cylinder 15 are engaged (the rotatable connection section 65 of the body cylinder 15 is inserted into the rotatable connection section 33 of the front cylinder 11). Next, a tail end 55 of the push rod 13 with a chuck is inserted from the topside into the internal hole 23 of the front cylinder 11 and pushed in an inside diameter section 30 of the synchronous engagement groove 31. Then, the bend stopper 51 is bent inward and passes downward the inside diameter section 30 of the synchronous engagement groove 31. Also, the bend stopper 51 subsequently passes through an inside diameter section 60 of the internal thread section 61 of the body cylinder 15. When external-thread-shaped projections 49L provided at the lowest step section of an outside surface of the push rod 47 reach upper surfaces of the synchronous engagement grooves 31, the unevennesses 49*a* provided at a periphery of the external-thread-shaped projections easily fit the synchronous engagement grooves 31 because the synchronous engagement grooves 31 are entirely formed on an inside surface of the front cylinder 11, and the unevennesses 49*a* pass downward along the synchronous engagement grooves 31. Similarly, all the external-thread-shaped projections 49 pass through the synchronous engagement grooves 31.

When the bend stopper 51 passes through the inside diameter section 60 of the internal thread section and comes out downward, spring back occurs and the bend stopper 51 turns into the state as shown in FIG. 2. Thus, the push rod 47 cannot come out upward and serves as a stopper.

When the lowest external-thread-shaped projection 49L is engaged with the internal thread 63 of the body cylinder 15, the front cylinder 11 and the body cylinder 15 are relatively rotated so as to retract the push rod 47 downward. FIG. 1 shows a state of the retracting limit defined resulting from the above.

That is to say, a principal characteristic of assembly of the container according to this embodiment is as follows. If the body cylinder 15 is in a state of rotating relatively to the front cylinder 11 when the push rod 47 is inserted in the front cylinder 11 and the body cylinder 15 from the upper part of them in a state that the front cylinder 11 and the body cylinder 15 are engaged, the push rod 47 will automatically be inserted downward spirally engaging with the body cylinder 15, whereby alignment or any skill will not be required and assembly suitable for automation will be possible.

After the assembly, a cosmetic material is directly filled in the internal hole 23 of the front cylinder 11. Incidentally, the cosmetic material is filled in a fluid state and is solidified after the filling. Therefore, the shape of the cosmetic material becomes identical to that of the internal hole 23 which is formed in a state that a lower end of the internal hole 23 is caught in the chuck 41.

Next, some other embodiments of the present invention will be described.

Figure 4:
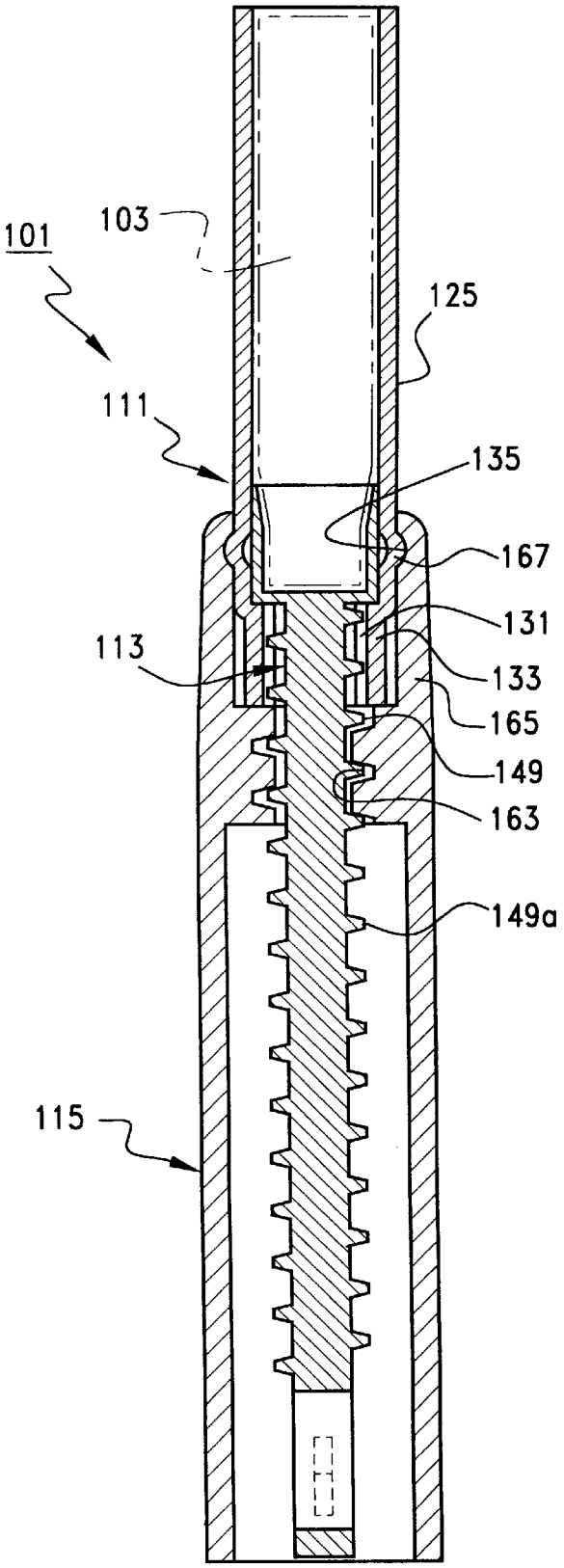
FIG. 4 is a sectional view showing the internal structure of a container for feeding a stick type cosmetic material according to another embodiment of the present invention.
Figure 5:
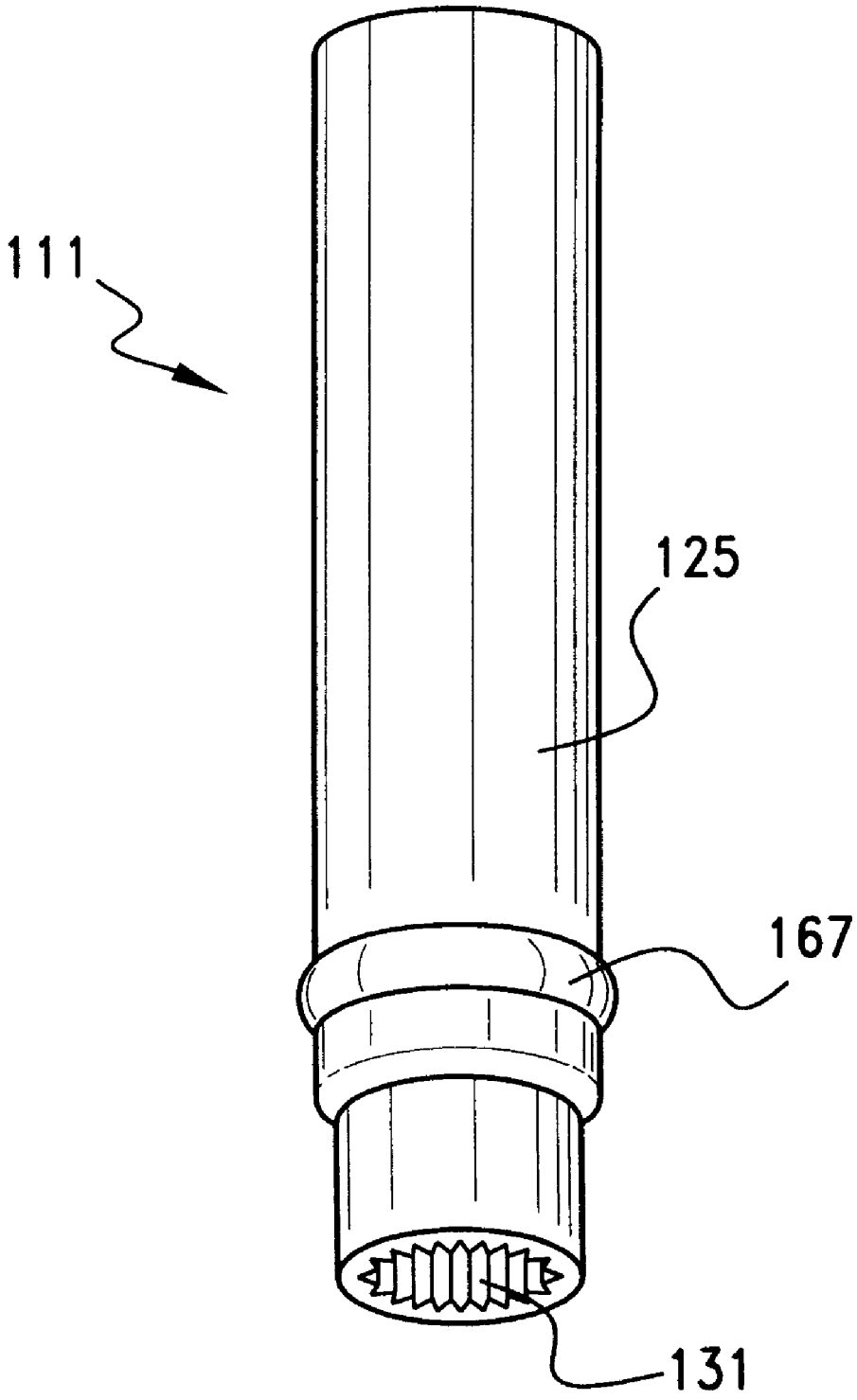
FIG. 5 is a perspective view showing the front cylinder shown in FIG. 4.

FIG. 4 is a sectional view showing the internal structure of a container for feeding a stick type cosmetic material according to another embodiment of the present invention. Incidentally, FIG. 5 is a perspective view showing a front cylinder of the container for feeding a stick type cosmetic material.

Among the reference numerals in the drawing, reference numerals made by adding numeral 100 to the reference numerals of FIG. 1 indicate parts similar to those of FIG. 1 excluding those specified hereinafter.

Characteristics of the container for feeding a stick type cosmetic material according to this embodiment are as follows.

(1) First, a front cylinder 111 is formed out of a drawing work of metals (aluminum, brass, etc.). A metal component is excellent in gloss and texture of the surface and creates a high-grade atmosphere which is important to a container for cosmetic materials. An annular convex 167 provided on an outside surface of the front cylinder 111 and a synchronous engagement groove 131 provided on an inside surface of a tail section are molded by plastic working, such as drawing.

(2) A rotatable connection section 133 of the front cylinder 111 is fitted in the body cylinder 115 from an outside of a rotatable connection section 165 of the body cylinder 115.

In the case of the container shown in FIG. 1, the bottom section 69 of the body cylinder 15 is short. Therefore, it is likely that the container does not match with the conventional containers for feeding a stick type cosmetic material in the atmosphere. Thus, in this embodiment, the body cylinder 115 is installed on an outer side of the container so that a visible portion of the body cylinder is long.

Figure 6A:
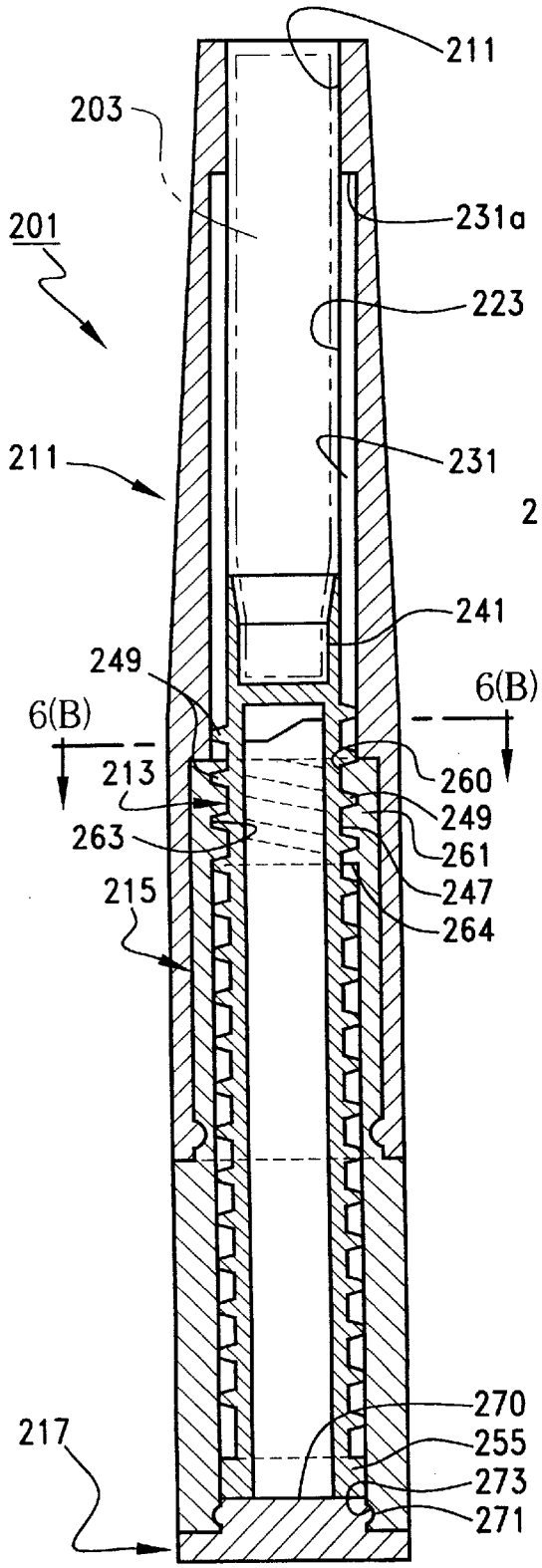
FIG. 6(A) is a sectional side view.
Figure 6B:
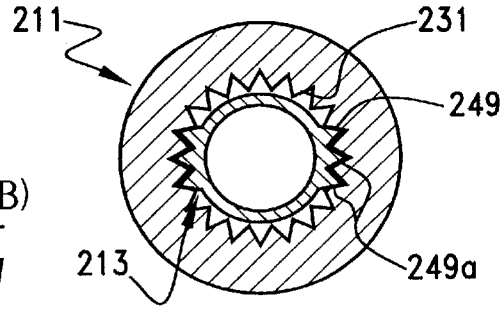
FIG. 6(B) is a sectional view taken along line B—B of FIG. 6(A).

FIG. 6 shows the internal structure of a container for feeding a stick type cosmetic material according to yet another embodiment. FIG. 6(A) is a sectional side view; FIG. 6(B) is a sectional view taken along line B—B of FIG. 6(A).

Among the reference numerals in the drawing, reference numerals made by adding numeral 200 to the reference numerals of FIG. 1 indicate parts similar to those of FIG. 1 excluding those specified hereinafter.

Characteristics of the container for feeding a stick type cosmetic material according to this embodiment are as follows.

(1) The container for feeding a stick type cosmetic material is not a type in which a cosmetic material is directly filled. Synchronous engagement grooves 231 are formed in such a manner that these grooves extend over almost entire length of a front cylinder internal hole 223, but they do not reach a tip end opening 221. In other words, a tip of the synchronous engagement groove 231 is a groove terminal step section 231*a*. The synchronous engagement groove 231 and the groove terminal step section 231*a* provided along the internal hole 223 constitute an obstacle to direct filling of the cosmetic material 203.

(2) The outside diameter of a chuck 241 is almost equal to that of a push rod 247, and the chuck 241 can pass through an inside diameter section 260 of an internal thread section 261 up and down.

(3) Further, in connection with the above, a tail closure 217 to define a retracting end of the push rod 247 and to prevent the push rod 247 from coming off is installed. The tail closure 217 has discoid two-stage structure and is stopped by engaging an annular convex 271 with an annular concavity 273 of a tail end section of the body cylinder 215. A lower end surface of a tail end flange 255 of the push rod 247 comes into contact with an upper surface of the tail closure 217 and a retracting stroke end of the push rod 247 is defined.

(4) The tail end flange 255 of the push rod 247 comes into contact with an internal step section 264 of a body cylinder internal thread section 261 at a feeding limit and a stroke end is defined. A push rod 213 with a chuck can be built in from the underneath of the body cylinder 215 and a front cylinder 211, and therefore the flange 255 is installed instead of a bend stopper.

Figure 7A:
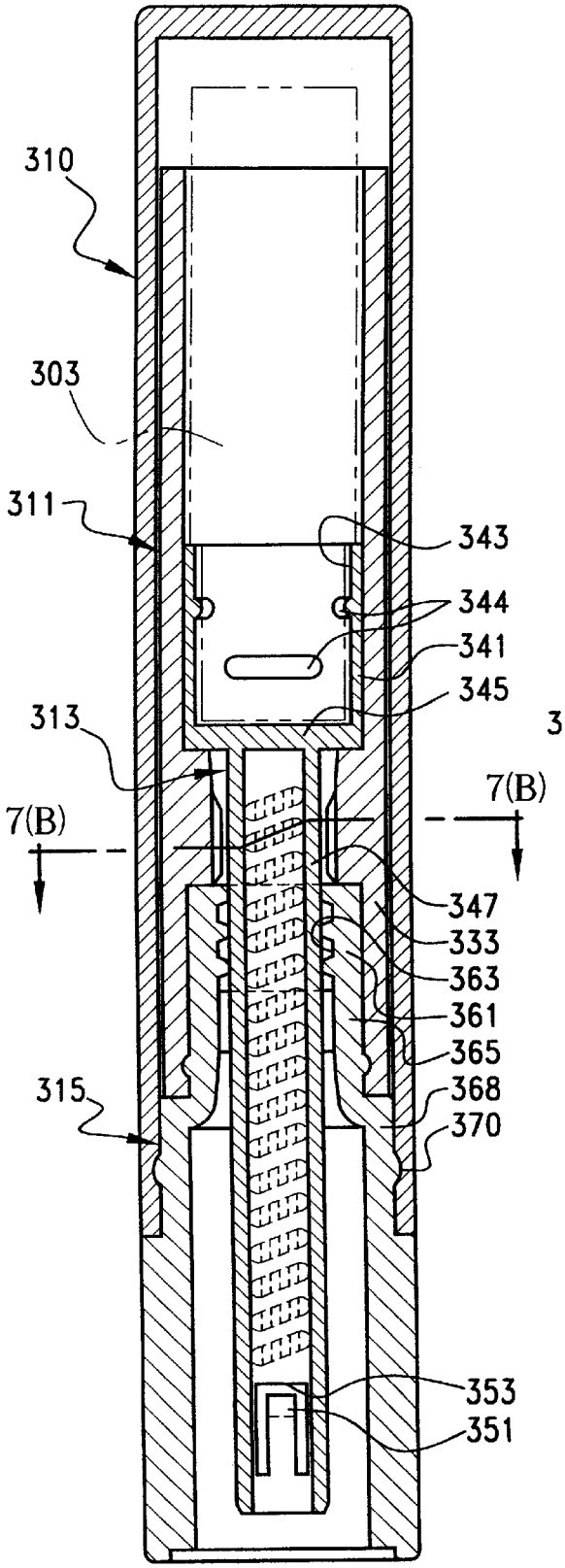
FIG. 7 is a sectional view showing a state of a push rod being at the retracting limit in the internal structure of a container for feeding a stick type cosmetic material according to yet another embodiment of the present invention.
Figure 7B:
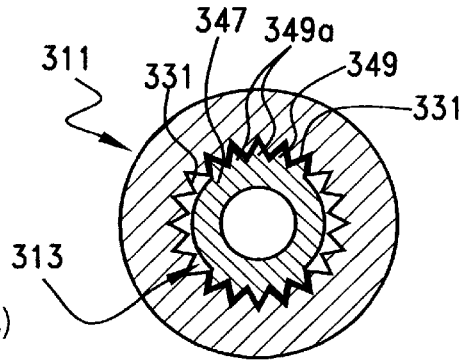
Figure 8:
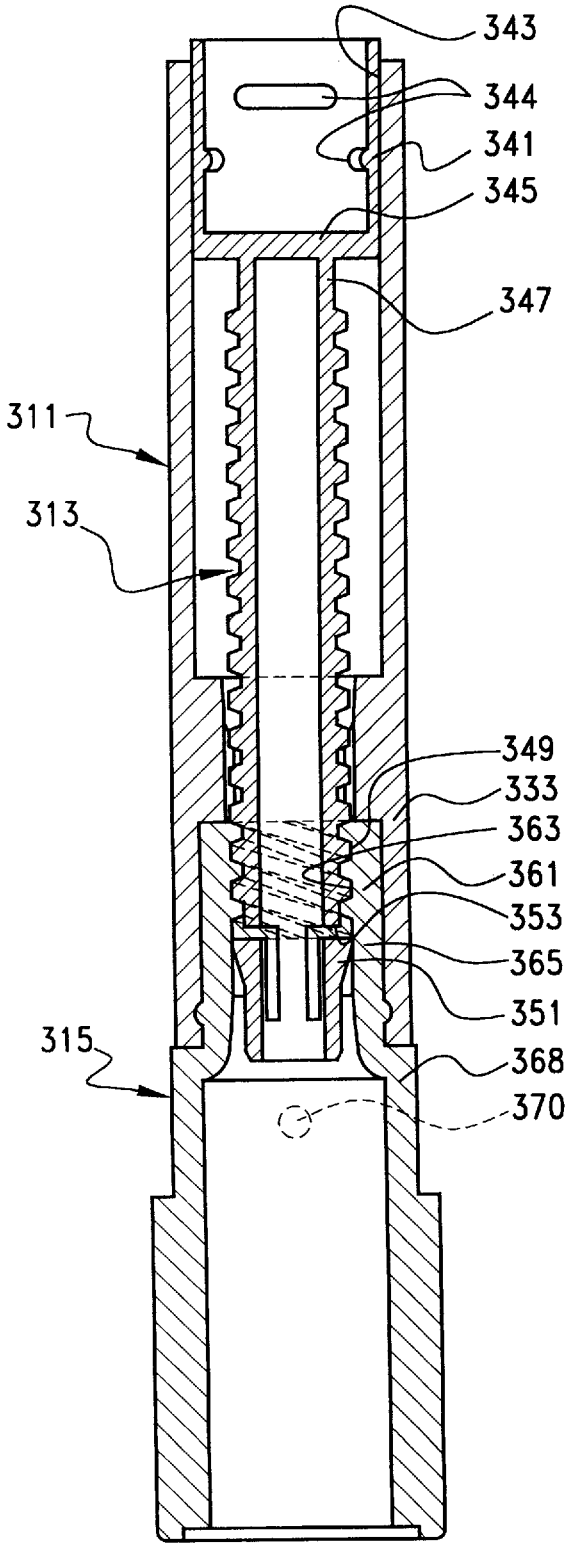
FIG. 8 is a sectional view showing a state of the push rod being at the feeding limit in the internal structure of a container for feeding a stick type cosmetic material according to yet another embodiment of the present invention.

FIGS. 7 and 8 are sectional views showing the internal structure of a container for feeding a stick type cosmetic material according to yet another embodiment of the present invention FIG. 7 shows a state of a push rod being at the retracting limit; FIG. 8 shows a state of the push rod being at the feeding limit.

Among the reference numerals in the drawing, reference numerals made by adding numeral 300 to the reference numerals of FIG. 1 indicate parts similar to those of FIG. 1 excluding those specified hereinafter.

Characteristics of the container for feeding a stick type cosmetic material according to this embodiment are as follows.

(1) The container has a cap 310. The cap 310 has a shape of a cylinder with a cover of an apex and covers an outside surface and an upper part of a front cylinder 311. The cap 310 is attached to an outside surface of a cap attachment section 368 provided at a center section of a body cylinder 315. An annular unevenness 370 is installed at the cap attachment section 368.

(2) A push rod 347 has hollow structure. Therefore, if a hole is made at the center of a bottom plate 345 of a chuck 341, a cosmetic material can be filled from the tail end side of the push rod 347. Incidentally, if the cosmetic material is filled from the tail end side of the push rod 347 as described above, an upper surface of the cosmetic material will be finished beautifully, which is an advantage.

Incidentally, in a cavity section 343 of the chuck 341, a cosmetic material stop projection 344 is installed inward.

(3) A bend stopper 351 of the push rod 347 is a ligulate piece which is formed in a U-shaped slit 353. The bend stopper 351 is formed in a shape of ligule by the U-shaped slit 353 which is formed on a wall surface of the hollow push rod 347. More specifically, the bend stopper 351 is easy to bend with the base (lower side) as a center because the bend stopper 351 is a cantilever whose base is a supporting section.

Figure 9:
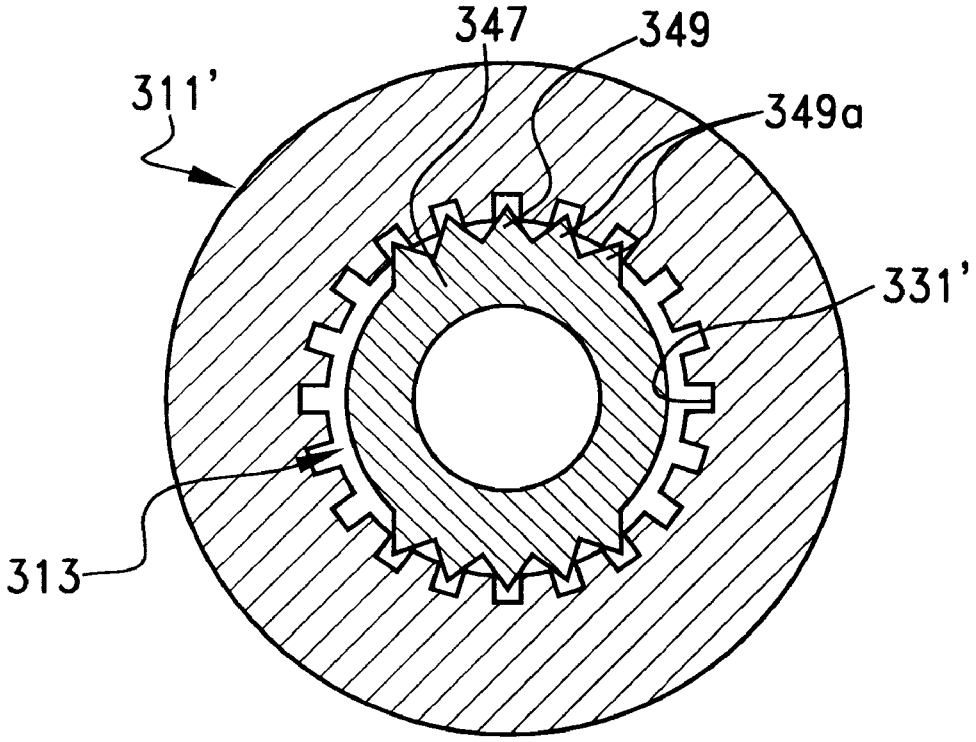
FIG. 9 is a sectional view showing an example which an unevenness of an external-thread-shaped projection and a synchronous engagement groove (synchronous engagement unevenness) of the front cylinder differ in shape.

FIG. 9 shows another embodiment in which an unevenness of an external-thread-shaped projection of the push rod and the synchronous engagement groove (synchronous engagement unevenness) differ in a shape.

Sections of both of the unevenness and the synchronous engagement groove are triangular in each of the embodiments described above, but in this embodiment, a section of an unevenness 349*a* is triangular, while a synchronous engagement groove 331' is a rectangle groove which can receive the unevenness 349*a*. Besides, various shapes of unevenness and synchronous engagement groove can be adopted.

Figure 10:
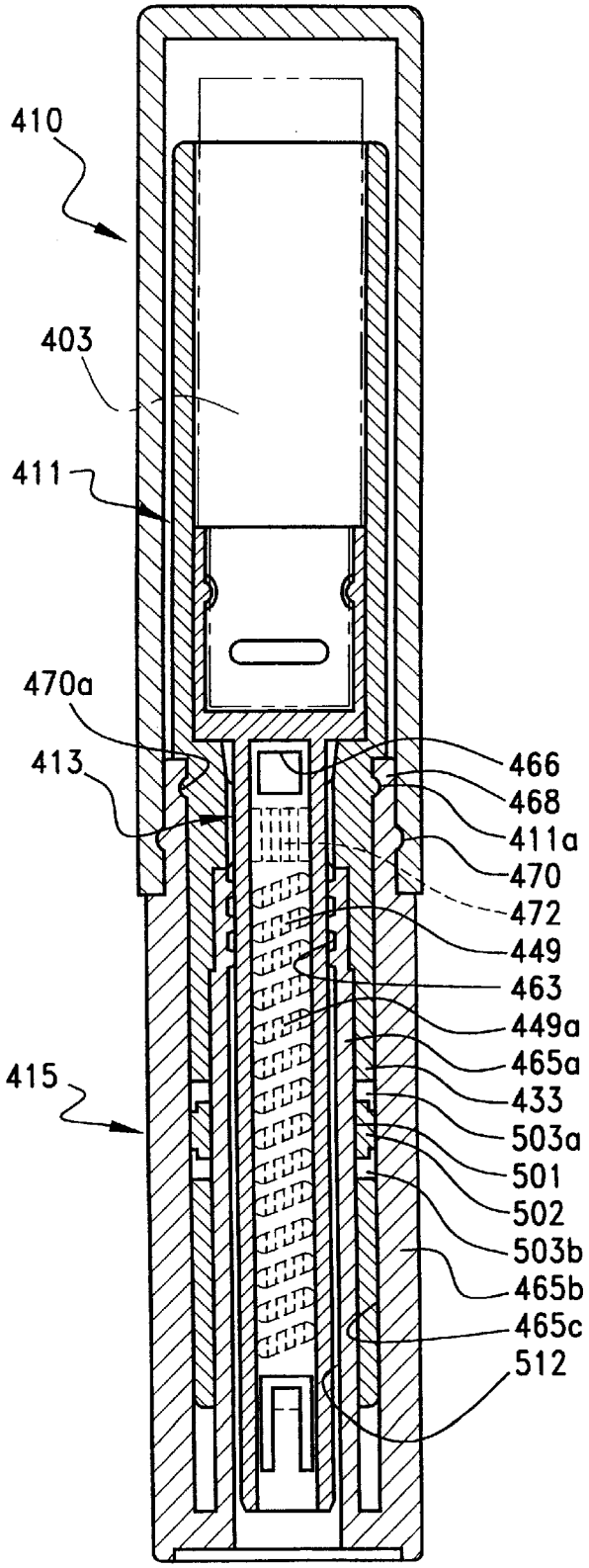
FIG. 10 is a sectional view showing the internal structure of a container for feeding a stick type cosmetic material according to yet another embodiment of the present invention.

FIG. 10 is a sectional view showing the internal structure of a container for feeding a stick type cosmetic material according to yet another embodiment of the present invention.

Figure 11A:
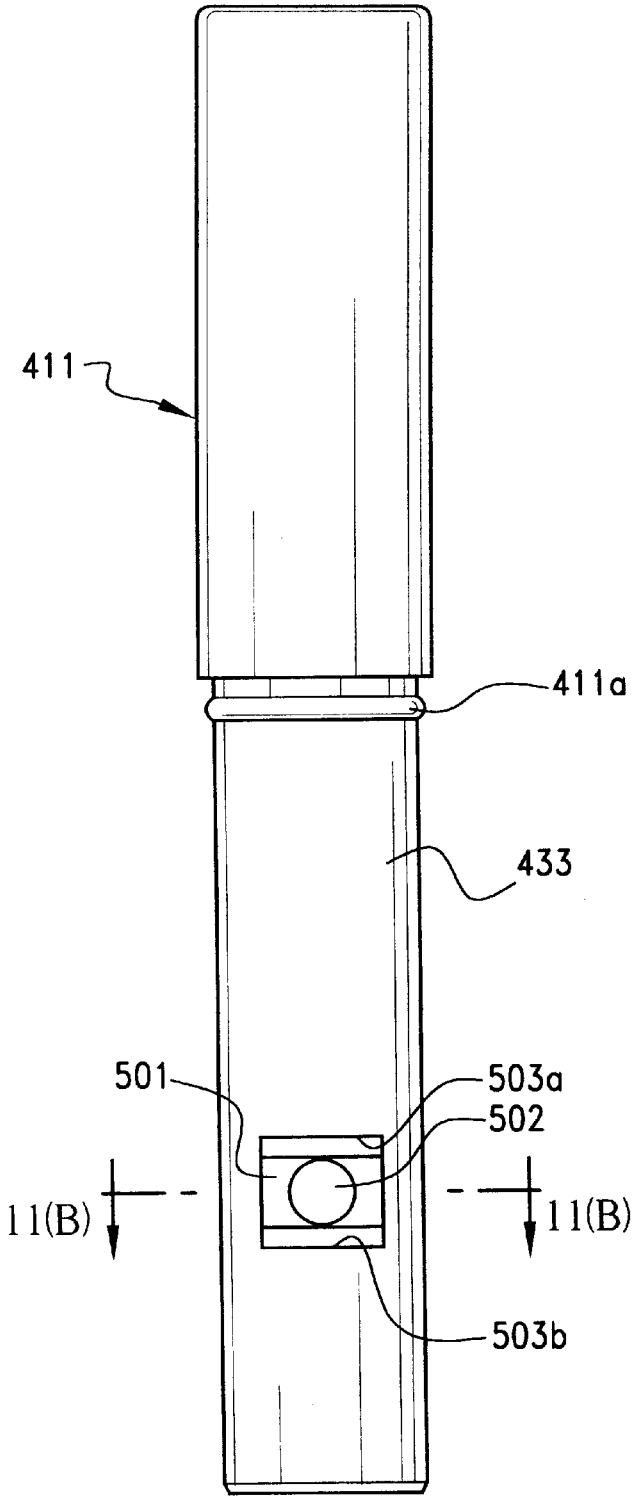
FIG. 11(A) is a side view.
Figure 11B:
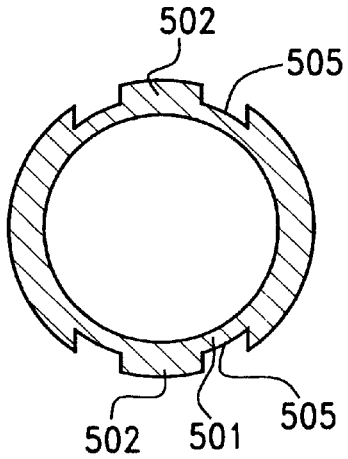
FIG. 11(B) is a sectional view taken along line B—B of FIG. 11(A).

FIG. 11 shows a front cylinder of the container shown in FIG. 10. FIG. 11(A) is a side view; FIG. 11(B) is a sectional view taken along line B—B of FIG. 10(A).

Figure 12A:
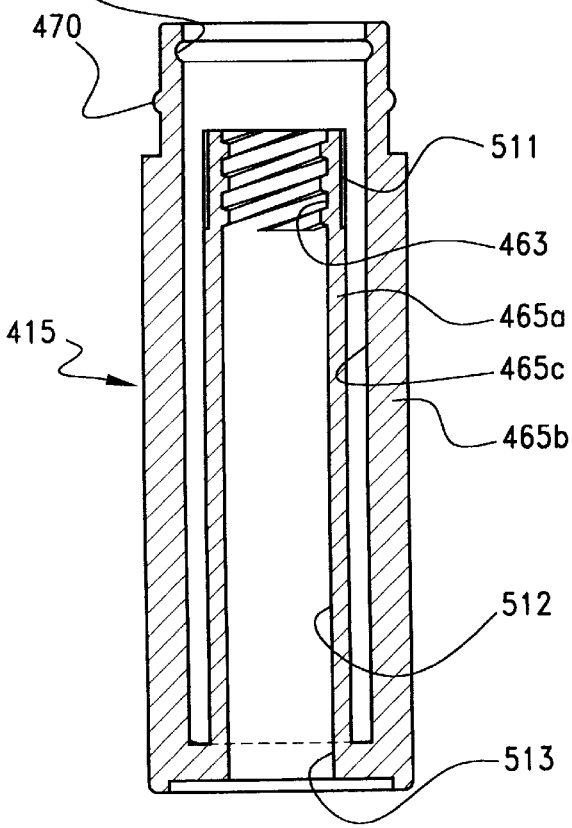
FIG. 12(A) is a sectional side view.
Figure 12B:
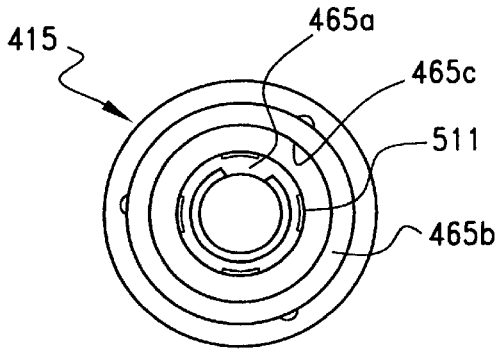
FIG. 12(B) is a plan view.
Figure 13:
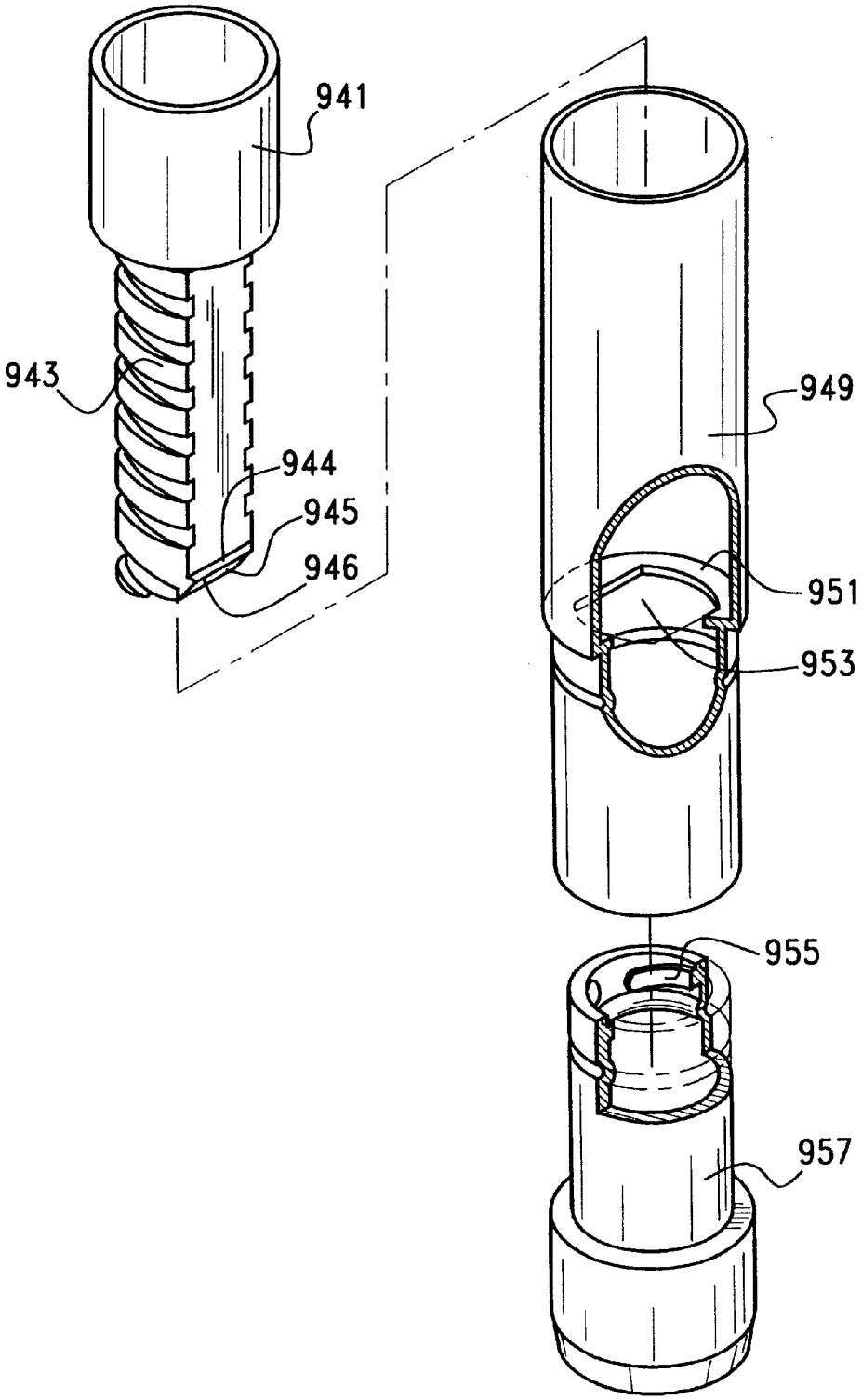
FIG. 13 is a partially exploded perspective view showing the structure of a conventional container for feeding a stick type cosmetic material.

FIG. 12 shows a body cylinder of the container shown in FIG. 10. FIG. 12(A) is a sectional side view; FIG. 12(B) is a plan view.

Among the reference numerals in the drawing, reference numerals made by adding numeral 400 to the reference numerals of FIG. 1 indicate parts similar to those of FIG. 1 excluding those specified hereinafter.

Characteristics of the container for feeding a stick type cosmetic material according to this embodiment are as follows.

(1) A body cylinder 415 has internal external double cylindrical structure in which two cylindrical bodies are connected at their tail sections, and the tail section of the front cylinder 411 is rotatably fitted between both of the cylinders 465*a* and 465*b*.

Internal threads 463 are formed on an upper inside surface of the inside cylinder 465*a* of the body cylinder 415. An upper outside surface of the outside cylinder 465*b* is a cap attachment section 468, and an annular concavity 470*a* connected with the front cylinder 411 (convex 411*a*) is formed on an upper outside surface of the outside cylinder 465*b*. A cylindrical deep concavity 465*c* is formed between the both cylinders 465*a* and 465*b*, and a rotatable connection section 433 provided at lower part of the front cylinder 411 is deeply fitted in the concavity 465*c*. Therefore, both of the cylinders are rotatably connected in a state that a slant of shaft centers of the front cylinder 411 and the body cylinder 415 is small.

In the body cylinder 415, no bottom is provided on the inside of a tail section of the inside cylinder 465*a* and an inside of the inside cylinder 465*a* is a through hollow hole 512. Further, on an outside surface of a tip section of the inside cylinder 465*a*, a whirl-stop groove 511 for mounting is formed as shown in FIG. 12.

At the time of plastic injection molding of the body cylinder 415, the outside surface is molded into the form of a split mold. However, it is also preferable to mold the body cylinder 415 in the form of a trimming die except a cap fitting section. Further, the concavity 465*c* is molded by a core pin for molding a concavity. The internal thread 463 of the inside cylinder 465*a* is inserted from the moving side by a core pin for molding a thread, and the hollow hole 512 of the inside cylinder 465*a* except an internal thread section is molded by a core pin for molding a hollow hole from the fixed side.

To be more concrete, a core pin for molding the hollow hole 512 rises from a die on the fixed side, the moving side has double structure composed of a first core pin which forms a concavity section corresponding to the concavity 465*c* and a screw core pin which forms the internal thread 463, and the internal thread core pin and the core pin for molding the hollow hole 512 are pressed and attached to each other. Further, the core pin for forming the concavity 465*c* is provided with the whirl-stop 511 to be used at the time of drawing an internal thread and a convex section which forms the annular concavity 470*a* engaged with the front cylinder 411. After injection molding, the die is released and the core pin for molding the hollow hole 512 comes out. The core pin for forming the internal thread 463 is then drawn out to the moving side, and finally the core pin for forming the concavity 465*c* is drawn out to the moving side, whereby the body cylinder 415 is formed.

(2) A bend piece 501 for giving rotation resistance and projection 502 are formed at the rotatable connection section 433 of the front cylinder 411. On a side wall of the front cylinder 411, two slits 503 which extend in an axial direction and a direction of right angle (a horizontal direction) are formed up and own and in parallel as shown in FIG. 11(A). And, a sidewall between two slits 503*a* and 503*b* is the circular bend piece 501 which is long from side to side.

FIG. 11(B) shows a section at right angles to the axis of the bend piece 501. Fundamentally, the bend piece 501 is a side wall of the front cylinder 411 itself, but a concavity 505 formed on an outside of the front cylinder 411 reduces the thickness of the front cylinder 411 and the wall thickness becomes two thirds of the side wall. By increasing or decreasing the depth or length of the concavity 505, rigidity of the bend piece 501 can be adjusted. As the bend piece 501 is a part of the cylinder side wall, the entire shape of the bend piece 501 is circular.

A circular resistance projection 502 is installed on an outside surface of the center of the bend piece 501. Two sets of the bend pieces 501 and the projections 502 are installed axisymmetrically facing each other at an angle of 180 degrees. These projections 502 make a rotating slide on an inside surface of the outside cylinder 465*b* of the body cylinder 415. A distance between apexes of two projections 502 is slightly wider than an inside diameter of the outside cylinder 465*b* prior to the assembly. When the front cylinder 411 is built in the body cylinder 415, the bend piece 501 is bent inward, and pressing force which is attendant on the elasticity applies between an outside surface of the projection 502 and an inside surface of the outside cylinder 465*b* of the body cylinder 415. The pressing force is similar to a lateral load which is imposed on an arch, and a bending stress is superior to a compressive stress in the bend piece 501.

The bend pieces 501 and the projection 502 function to eliminate looseness between the front cylinder 411 and the body cylinder 415 and give appropriate resistance to the rotation of both cylinders so that a user can have the feeling of smooth feeding operation. Thus, a high grade atmosphere of the container is created.

(3) A square hole 466 provided right below the chuck of the push rod 413 is a core pin presser to prevent the swing of the core pin. A vertical line 472 provided on an upper outside surface of the push rod 413 with a chuck is a sequence of unevennesses, and the unevennesses run in a line with unevennesses 449*a* of lower part external-thread-shaped projections 449. The vertical line 472 is not spirally engaged with the internal threads 463. Unlike other embodiments, the vertical line 472 fulfills the role of a whirl-stop of the front cylinder 411 and the push rod 413 with a chuck at the initial start-up of feeding in this embodiment. Further, the vertical line 472 can also be used as a retracting limit stopper.

As described above, the present invention can provide a container for feeding a stick type cosmetic material which can reduce the number of parts and is easy to assemble. Further, a container for feeding a stick type cosmetic material which is suitable for direct filling of a cosmetic material can be provided. Further, in the embodiment shown in FIGS. 10 to 12, a body cylinder of the container is provided with a cap fitting section, a front cylinder rotation section, a front cylinder engagement concavity, an internal thread section, and surface exterior although only a single member is used. Thus, unlike the conventional container, complicated components are not required.

The present invention is not restricted to the embodiments described above, it is obvious that various modifications can be made within the technical idea of the present invention given in the claim.

What is claimed is:

1. A container for feeding a stick type cosmetic material comprising:

a chuck for retaining a stick type cosmetic material;

a front cylinder which has an internal hole for guiding the chuck to easily slide in an axial direction;

a push rod which is connected with the chuck and also has external-thread-shaped projections on its outside surface; and a body cylinder which is rotatably connected with the front cylinder and also has internal threads to be spirally engaged with the external-thread-shaped projections of the push rod, wherein unevennesses having an almost same section are formed on a periphery surface of the external-thread-shaped projections of the push rod, and synchronous engagement unevennesses, which are engaged with the unevennesses to prevent relative rotation between the push rod and the front cylinder, are formed on an inside surface of the front cylinder.

2. The container for feeding a stick type cosmetic material according to claim 1, wherein the unevennesses formed on a periphery surface of the external-thread-shaped projections of the push rod are plural and are formed at a sequence of fixed pitches.

3. The container for feeding a stick type cosmetic material according to claim 1, wherein the synchronous engagement unevennesses are formed on an entire circumference of an inside surface of the front cylinder.

4. The container for feeding a stick type cosmetic material according to claim 3, wherein the synchronous engagement unevennesses are formed on an inside surface of a flange section of small inside diameter installed at a lower part of the internal hole for sliding the chuck which is provided at the front cylinder.

5. The container for feeding a stick type cosmetic material according to claim 1, wherein the push rod is formed in a manner that the push rod and a chuck are united; a bend stopper which has an outward projection section projecting over a periphery surface of the push rod is installed at a tail section of the push rod; a stopper contact section is installed at a lower part of the internal threads of the body cylinder; when the push rod is passed through the body cylinder at the time of assembly, the bend stopper bends inward so that the bend stopper can pass inside the internal thread; after the assembly, the bend stopper is restored to an original; and at a feeding end of the push rod, the bend stopper comes into contact with the stopper contact section, whereby feeding of the push rod is restricted.

6. The container for feeding a stick type cosmetic material according to claim 1, wherein the push rod is molded out of plastic into the form of a half mold by injection, and the external-thread-shaped projections are plurally formed at a position apart from a molding parting line facing each other with a shaft center of the push rod between.

7. The container for feeding a stick type cosmetic material according to claim 1, wherein the external-thread-shaped projections of the push rod are formed in a range equivalent to at least length of a stroke of the container, and the internal threads are installed on a tip side of the body cylinder, extending over length which is enough for the internal threads to be spirally engaged with several of the external-thread-shaped projections.

8. The container for feeding a stick type cosmetic material according to claim 1, wherein the body cylinder has internal and external double cylindrical structure in which two cylindrical bodies are connected at their tail sections, and a bottom section of the front cylinder is rotatably engaged between these cylindrical bodies.

9. The container for feeding a stick type cosmetic material according to claim 8, wherein the internal threads are formed at a tip section of an inside cylindrical body of the body cylinder, similarly a cap stopper section is formed at a tip section of an outside surface of an outside cylindrical body, and annular circular unevennesses connected with the front cylinder are formed at a tip section of an inside surface of the outside cylindrical body.

10. The container for feeding a stick type cosmetic container according to claim 8, wherein there is no bottom at a tail section of the inside cylindrical body of the body cylinder.

11. The container for feeding a stick type cosmetic material according to claim 8, wherein a slide resistance application section composed of a bend piece is formed between the body cylinder and the front cylinder.

* * * * *